US009108784B2

(12) United States Patent
Pipes et al.

(10) Patent No.: US 9,108,784 B2
(45) Date of Patent: Aug. 18, 2015

(54) DISPENSING CONTAINER, PACKAGED PRODUCT ASSEMBLY, AND RELATED METHOD

(75) Inventors: Jerry W. Pipes, Clemmons, NC (US); William P. Scott, Clemmons, NC (US); Melissa A. Clark, Mocksville, NC (US); Wesley S. Jones, Lexington, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 311 days.

(21) Appl. No.: 13/538,400

(22) Filed: Jun. 29, 2012

(65) Prior Publication Data

US 2014/0001194 A1 Jan. 2, 2014

(51) Int. Cl.
*B65D 83/04* (2006.01)

(52) U.S. Cl.
CPC ..... *B65D 83/0463* (2013.01)

(58) Field of Classification Search
CPC ..... B65D 83/0463; A61J 1/035
USPC ..... 221/25, 28, 30
See application file for complete search history.

(56) References Cited

U.S. PATENT DOCUMENTS

| | | | | |
|---|---|---|---|---|
| 3,380,578 | A | 4/1968 | Sparks | |
| 3,689,458 | A | 9/1972 | Hellstron | |
| 3,732,663 | A | 5/1973 | Geldmacher | |
| 3,872,970 | A | 3/1975 | Edison | |
| 3,948,394 | A | 4/1976 | Hellstrom | |
| 3,968,880 | A | 7/1976 | Ostrowsky | |
| 4,120,400 | A | 10/1978 | Kotyuk | |
| 4,125,190 | A | 11/1978 | Davie, Jr. et al. | |
| 4,169,531 | A | 10/1979 | Wood | |
| 4,778,054 | A * | 10/1988 | Newell et al. | 206/531 |
| 4,971,221 | A * | 11/1990 | Urquhart et al. | 221/25 |

(Continued)

FOREIGN PATENT DOCUMENTS

| | | |
|---|---|---|
| DE | 38 38 144 | 5/1990 |
| EP | 1 762 508 | 3/2007 |

(Continued)

OTHER PUBLICATIONS

International Search Report and Written Opinion of the International Searching Authority for corresponding International Application No. PCT/US2013/047597 mailed Dec. 13, 2013.

(Continued)

*Primary Examiner* — Timothy Waggoner
(74) *Attorney, Agent, or Firm* — Womble Carlyle Sandridge & Rice, LLP

(57) ABSTRACT

A packaged product assembly is provided. The packaged product assembly may include a packet received in a dispensing container. The packet may be a blister packet including units of a product received in sealed cavities. The dispensing container may include a top casing and a bottom casing. The upper casing may be pivotably connected to the lower casing such that the upper casing is moveable between a closed position in which access to the packet is substantially blocked, and an open position in which access to the packet is provided. The packet may be supported by a shoulder defined at an inner surface of sidewalls of the lower casing such that a receptacle is formed between the packet and a major wall of the lower casing. A unit of the product released from one of the sealed cavities may be received in the receptacle and dispensed via a dispensing aperture.

12 Claims, 11 Drawing Sheets

(56) References Cited

U.S. PATENT DOCUMENTS

| | | | | |
|---|---|---|---|---|
| 5,325,968 | A | 7/1994 | Sowden | |
| 5,348,158 | A * | 9/1994 | Honan et al. | 206/531 |
| 5,878,887 | A | 3/1999 | Parker et al. | |
| 5,988,429 | A * | 11/1999 | Coe | 221/25 |
| 6,349,831 | B1 | 2/2002 | Buss | |
| 6,460,693 | B1 | 10/2002 | Harrold | |
| 6,540,081 | B2 * | 4/2003 | Balz et al. | 206/531 |
| 6,679,381 | B1 | 1/2004 | Bush | |
| 6,679,382 | B1 | 1/2004 | Kancsar et al. | |
| 7,431,160 | B2 * | 10/2008 | Drought et al. | 206/531 |
| 7,481,331 | B2 * | 1/2009 | Webster et al. | 221/25 |
| 2003/0042167 | A1 | 3/2003 | Balz et al. | |
| 2007/0023317 | A1 | 2/2007 | Brozell et al. | |
| 2010/0264153 | A1 | 10/2010 | Bellamah et al. | |
| 2011/0011756 | A1 | 1/2011 | Bellamah | |
| 2011/0049003 | A1 | 3/2011 | Bellamah et al. | |
| 2011/0272323 | A1 | 11/2011 | Ziemba et al. | |
| 2012/0061396 | A1 | 3/2012 | Ortenzi et al. | |

FOREIGN PATENT DOCUMENTS

| | | |
|---|---|---|
| WO | WO 2004/034952 | 4/2004 |
| WO | WO 2004/035421 | 4/2004 |
| WO | WO 2010/081693 | 7/2010 |
| WO | WO 2010/094505 | 8/2010 |

OTHER PUBLICATIONS

Invitation to Pay Additional Fees and Partial International Search from corresponding International Application No. PCT/US2013/047597 mailed Oct. 4, 2013.

* cited by examiner

DISPENSING CONTAINER, PACKAGED PRODUCT ASSEMBLY, AND RELATED METHOD

BACKGROUND OF THE DISCLOSURE

1. Field of the Disclosure

The present disclosure relates to dispensing containers and methods of use thereof. More particularly, the present disclosure relates to dispensing containers configured to dispense products from blister packs including products, made from, or derived from tobacco, or that otherwise incorporate tobacco, and are intended for human consumption.

2. Description of Related Art

Certain consumable products, such as pharmaceutical products, may be preferably stored in packets commonly referred to as "blister packs." Blister packs are packages defining cavities in which a single unit of product is typically stored. The units of product may be respectively sealed in the cavities. A unit of product is removable from a cavity by applying pressure at one of the cavities to cause the unit of product to rupture the cavity and exit therefrom.

However, blister packs may not be suitable for carrying by a consumer. In this regard, blister packs may define an unergonomic shape that is uncomfortable for carrying. Further, a consumer may desire discretion with respect to the identity of the product in the blister pack. Additionally, it may be possible to accidentally puncture one of the cavities in the blister pack, which may undesirably expose the unit of product to atmospheric conditions. Also, existing embodiments of blister packs may offer child-resistance, but the features employed to achieve child-resistance may make the blister packs difficult to use.

Accordingly, there remains a need in the art for a container for storing and dispensing a product from a blister pack.

BRIEF SUMMARY OF THE DISCLOSURE

The above and other needs are met by various aspects of the present disclosure, wherein, in one aspect, a dispensing container is provided. The dispensing container may comprise an upper casing and a lower casing configured to engage the upper casing. The lower casing may comprise a major wall and a plurality of sidewalls extending from the major wall to an upper end. The sidewalls may define a shoulder extending around an inner surface thereof and configured to engage an edge of a packet defining a plurality of sealed cavities in which a plurality of units of a product are received such that the packet is supported at a position between the upper end and the major wall. A receptacle may be defined between the packet and the major wall of the lower casing. The receptacle may be configured to receive one of the units of the product from one of the sealed cavities and the one of the units of the product is removable from the receptacle via a dispensing aperture.

In some embodiments the dispensing aperture may be defined in one of the sidewalls of the lower casing. The lower casing may further comprise a door configured to pivot to open and close the dispensing aperture. The upper casing may be pivotably coupled to the lower casing and the upper casing may comprise an extension configured to close the dispensing aperture when the upper casing is in a closed position and open the dispensing aperture when the upper casing is in an open position. The lower casing may further comprise a retention member configured to at least partially limit access to the extension.

In some embodiments the dispensing aperture may be defined in the major wall of the lower casing. The lower casing may further comprise a door configured to pivot to open and close the dispensing aperture. The upper casing may prevent access to the packet when configured in a closed position. The upper casing may define a plurality of access ports aligned with the sealed cavities in the packet and configured to provide access to the sealed cavities. The dispensing container may further comprise a button configured to release the upper casing from the lower casing to provide access to the packet.

In another aspect a packaged product assembly is provided. The packaged product assembly may comprise a packet and a dispensing container. The packet may comprise a displaceable layer and a rupturable layer collectively defining a plurality of sealed cavities in which a plurality of units of a product are received. The dispensing container may comprise an upper casing and a lower casing configured to engage the upper casing. The lower casing may comprise a major wall and a plurality of sidewalls extending from the major wall to an upper end. The sidewalls may define a shoulder extending around an inner surface thereof and engaged with an edge of the packet such that the packet is supported at a position between the upper end and the major wall. Upon depressing the displaceable layer of the packet at one of the sealed cavities, one of the units of the product may rupture the rupturable layer of the packet and be received in a receptacle defined between the packet and the major wall of the lower casing. The one of the units of the product may be removable from the receptacle via a dispensing aperture.

In some embodiments the dispensing aperture may be defined in one of the sidewalls of the lower casing. The lower casing may further comprise a door configured to pivot to open and close the dispensing aperture. The upper casing may be pivotably coupled to the lower casing and the upper casing may comprise an extension configured to close the dispensing aperture when the upper casing is in a closed position and open the dispensing aperture when the upper casing is in an open position. The lower casing may further comprise a retention member configured to at least partially limit access to the extension. The dispensing aperture may be defined in the major wall of the lower casing. The lower casing may further comprise a door configured to pivot to open and close the dispensing aperture.

In some embodiments the upper casing may prevent access to the packet when configured in a closed position. The upper casing may define a plurality of access ports aligned with the sealed cavities in the packet and configured to provide access to the sealed cavities. The packet may comprise a frame configured to stiffen the packet. A button may be configured to release the upper casing from the lower casing to provide access to the packet. The dispensing aperture may be defined at least in part by the packet. Further, the packet may be replaceable.

In some embodiments the product may be selected from the group consisting of pharmaceutical products, smoking products, smokeless tobacco products, and consumable products. For example, the product may be a smokeless tobacco product in one particular embodiment.

In an additional aspect a method is provided. The method may comprise providing a packet comprising a displaceable layer and a rupturable layer collectively defining a plurality of sealed cavities in which a plurality of units of a product are received. The method may further comprise providing a dispensing container comprising an upper casing and a lower casing. The lower casing may comprise a major wall and a plurality of sidewalls extending from the major wall to an upper end. The sidewalls may define a shoulder extending around an inner surface thereof. The method may additionally include engaging an edge of the packet with the shoulder of the lower casing such that the packet is supported at a position between the upper end and the major wall. Upon depressing the displaceable layer of the packet at one of the sealed cavities one of the units of the product may rupture the rupturable layer of the packet and be received in a receptacle defined between the packet and the major wall of the lower casing. The one of the units of the product may be removable from the receptacle via a dispensing aperture.

In some embodiments the method may further comprise pivoting the upper casing to a closed position in which access to the packet is substantially prevented. Pivoting the upper casing to a closed configuration may comprise closing the dispensing aperture with an extension defined by the upper casing. The method may also include limiting access to the extension with a retention member.

Aspects of the present disclosure thus address the identified needs and provide other advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

Figure 1:
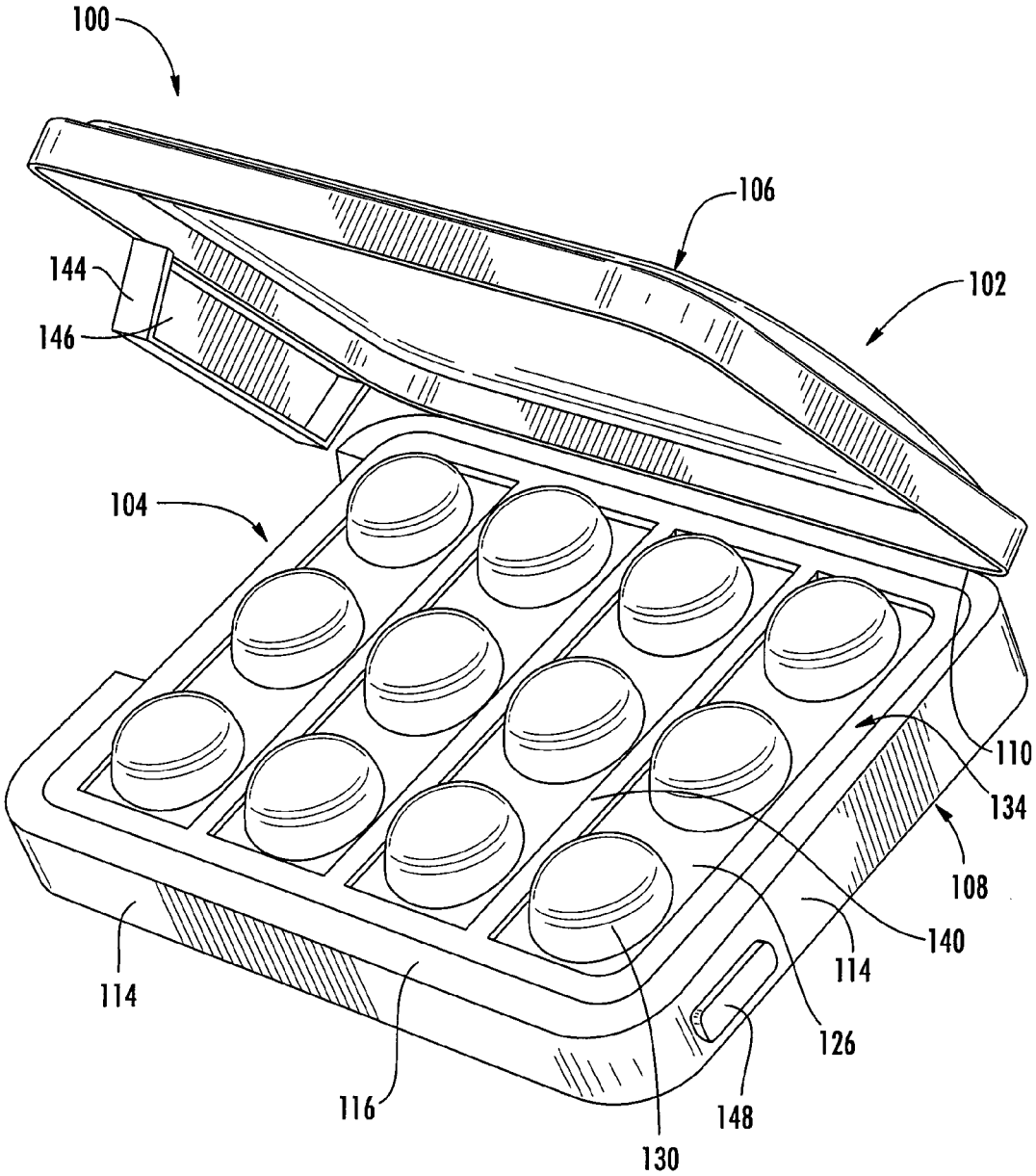
FIG. 1 illustrates a perspective view of a packaged product assembly comprising a packet and a dispensing container with a dispensing aperture closeable via an extension defined by an upper casing according to a first example embodiment of the present disclosure.

The present disclosure now will be described more fully hereinafter with reference to the accompanying drawings, in which some, but not all aspects of the disclosure are shown. Indeed, the disclosure can be embodied in many different forms and should not be construed as limited to the aspects set forth herein; rather, these aspects are provided so that this disclosure will satisfy applicable legal requirements. Like numbers refer to like elements throughout.

As described herein, embodiments of the disclosure relate to apparatuses and methods for dispensing products. In particular, the apparatuses and methods disclosed herein relate to dispensing containers for storing and dispensing units of product from packets generally referred to as "blister packs." Examples of blister packs and related packaging may be found in the following: U.S. Pat. No. 3,610,410 to Seeley; U.S. Pat. No. 3,689,458 to Hellstrom; U.S. Pat. No. 3,732,663 to Geldmacher et al.; U.S. Pat. No. 3,792,181 to Mahaffy et al.; U.S. Pat. No. 3,812,963 to Zahuranec et al.; U.S. Pat. No. 3,948,394 to Hellstrom; U.S. Pat. No. 3,967,730 to Driscoll et al.; U.S. Pat. No. 4,120,400 to Kotyuk; U.S. Pat. No. 4,169,531 to Wood; U.S. Pat. No. 4,383,607 to Lordahl et al.; U.S. Pat. No. 4,535,890 to Artusi; U.S. Pat. No. 5,009,894 to Hsiao; U.S. Pat. No. 5,033,616 to Wyser; U.S. Pat. No. 5,147,035 to Hartman; U.S. Pat. No. 5,154,293 to Gould; U.S. Pat. No. 5,878,887 to Parker et al.; and U.S. Pat. No. 6,520,329 to Fuchs et al., each of which is incorporated herein by reference. Examples of blister packs and related packaging including child-resistant features may be found in the following: U.S. Pat. No. 3,630,346 to Burnside; U.S. Pat. No. 3,809,220 to Arcudi et al.; U.S. Pat. No. 3,835,995 to Haines et al.; U.S. Pat. No. 3,872,970 to Edison; U.S. Pat. No. 3,912,081 to Haines et al.; U.S. Pat. No. 3,921,805 to Compere et al.; U.S. Pat. No. 3,924,746 to Haines et al.; U.S. Pat. No. 3,941,248 to Moser et al.; U.S. Pat. No. 4,011,949 to Braber et al.; U.S. Pat. No. 4,125,190 to Davie, Jr. et al.; U.S. Pat. No. 4,231,477 to Felice; U.S. Pat. No. 4,243,144 to Margulies; U.S. Pat. No. 4,280,621 to Tonrey; U.S. Pat. No. 4,294,361 to Margulies et al.; U.S. Pat. No. 4,398,635 to Hirt; U.S. Pat. No. 4,537,312 to Intini; U.S. Pat. No. 4,781,294 to Croce; U.S. Pat. No. 4,988,004 to Intini; U.S. Pat. No. 5,046,618 to Wood; U.S. Pat. No. 5,088,603 to Kirkpatrick; U.S. Pat. No. 5,172,812 to Wharton et al.; U.S. Pat. No. 5,325,968 to Sowden; U.S. Pat. No. 5,339,960 to Price; U.S. Pat. No. 5,358,118 to Thompson et al.; U.S. Pat. No. 5,511,665 to Dressel et al.; U.S. Pat. No. 5,758,774 to Leblong; U.S. Pat. No. 5,775,505 to Vasquez et al.; U.S. Pat. No. 5,785,180 to Dressel et al.; U.S. Pat. No. 5,894,930 to Faughey et al.; U.S. Pat. No. 5,944,191 to Ray et al.; U.S. Pat. No. 6,161,699 to Gartland; U.S. Pat. No. 6,375,956 to Hermelin et al.; U.S. Pat. No. 6,394,275 to Paliotta et al.; U.S. Pat. No. 6,422,391 to Swartz; U.S. Pat. No. 6,679,382 to Kancsar et al.; and U.S. Pat. No. 7,401,702 to Hession, each of which is incorporated herein by reference.

By employing a dispensing container to store the blister pack, the blister pack may be stored in a convenient form factor that may prevent accidental puncture of the sealed cavities of the blister pack. Examples of containers for dispensing from blister packs may be found in the following: U.S. Pat. No. 3,380,578 to Sparks; U.S. Pat. No. 3,968,880 to Ostrowsky; U.S. Pat. No. 5,878,887 to Parker et al.; U.S. Pat. No. 6,349,831 to Buss; U.S. Pat. No. 6,460,693 to Harrold; U.S. Pat. No. 6,540,081 to Balz et al.; U.S. Pat. No. 6,679,381 to Bush; and U.S. Pat. No. 7,481,331 to Webster et al. and U.S. Patent Application Publication Nos. 2010/0264153 to Bellamah et al.; 2011/0011756 to Bellamah; 2011/0049003 to Bellamah et al.; 2011/0272323 to Ziemba et al.; and 2012/0061396 to Ortenzi et al., each of which is incorporated herein by reference.

However, existing embodiments of blister packs may not offer a level of convenience and, optionally, a level of child-resistance that is desirable. In this regard, FIG. 1 illustrates a first embodiment of a packaged product assembly 100. The packaged product assembly 100 includes a dispensing container 102 and a packet 104 received therein. As described in greater detail below, the packet 104 may comprise a blister pack. Moreover, the dispensing container 102 can be characterized as being a clamshell container.

The dispensing container 102 may comprise an upper casing 106 and a lower casing 108. The upper casing 106 may be pivotable relative to the lower casing 108 between an open position, in which access to the packet 104 is provided, and a closed position in which the lower casing engages the upper casing and access to the packet 104 is substantially blocked. The upper casing 106 and the lower casing 108 may comprise an integral structure in some embodiments. For example, the upper casing 106 and the lower casing 108 may be connected by a thin strip of material at an edge 110. However, in other embodiments a separate hinge may be provided to connect the upper casing 106 and the lower casing 108, or the upper casing and the lower casing may be configured between open and closed positions via other mechanisms and manners, such as through interference fit. The dispensing container 102 may be formed from various embodiments of materials including, for example, plastic, paperboard, and metal. However, various other types of materials may be employed in other embodiments.

Figure 2:
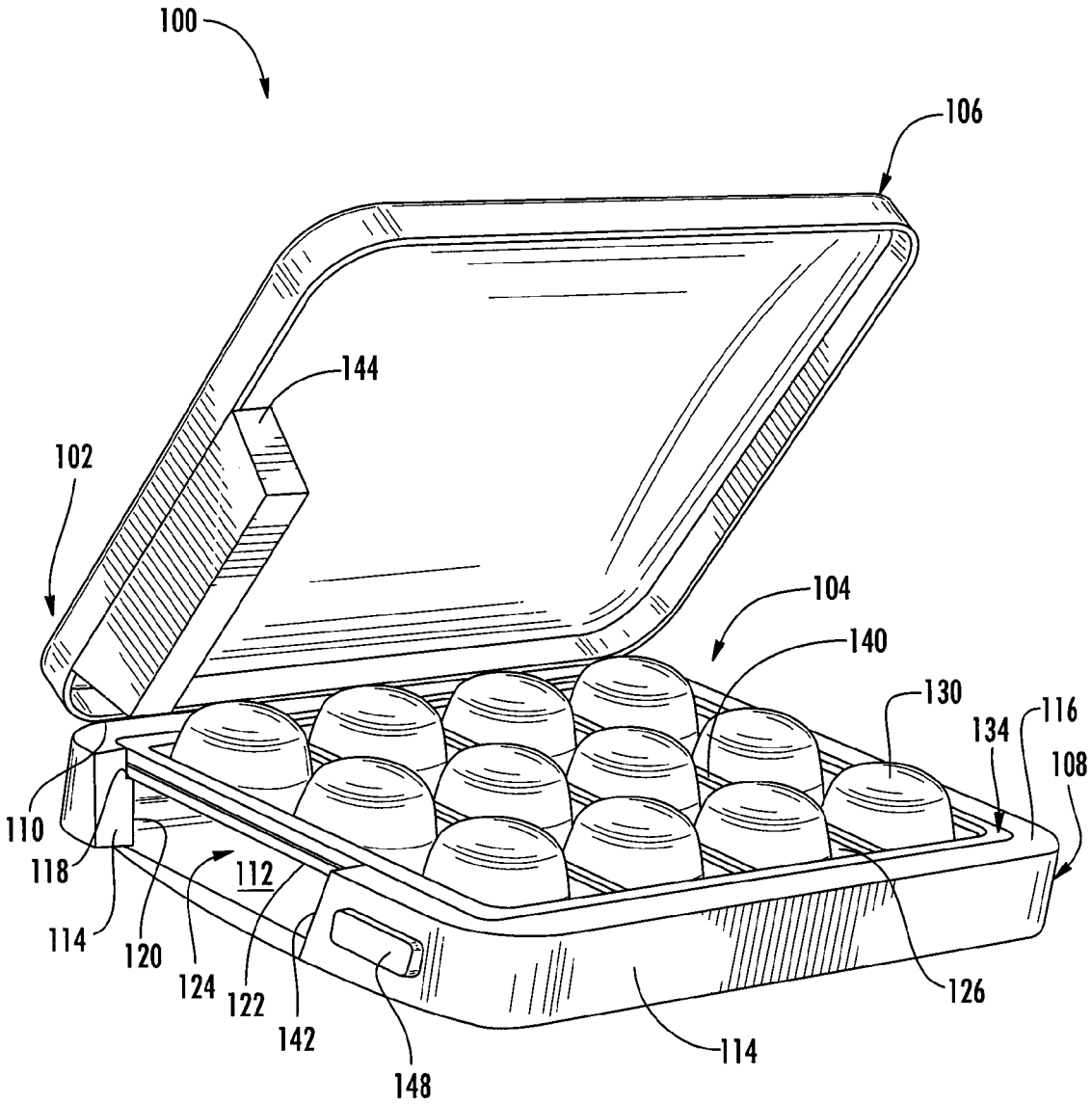
FIG. 2 illustrates an alternate perspective view of the packaged product assembly of FIG. 1.

As illustrated in FIG. 2, the lower casing 108 may comprise a major wall 112 and a plurality of sidewalls 114 extending from the major wall to an upper end 116. The sidewalls 114 may define a shoulder 118 extending around an inner surface 120 of the sidewalls. The shoulder 118 may define a flat shelf configured to engage an edge 122 of the packet 104 such that the packet is supported at position between the upper end 116 and the major wall 112 of the lower casing 108.

Figure 3:
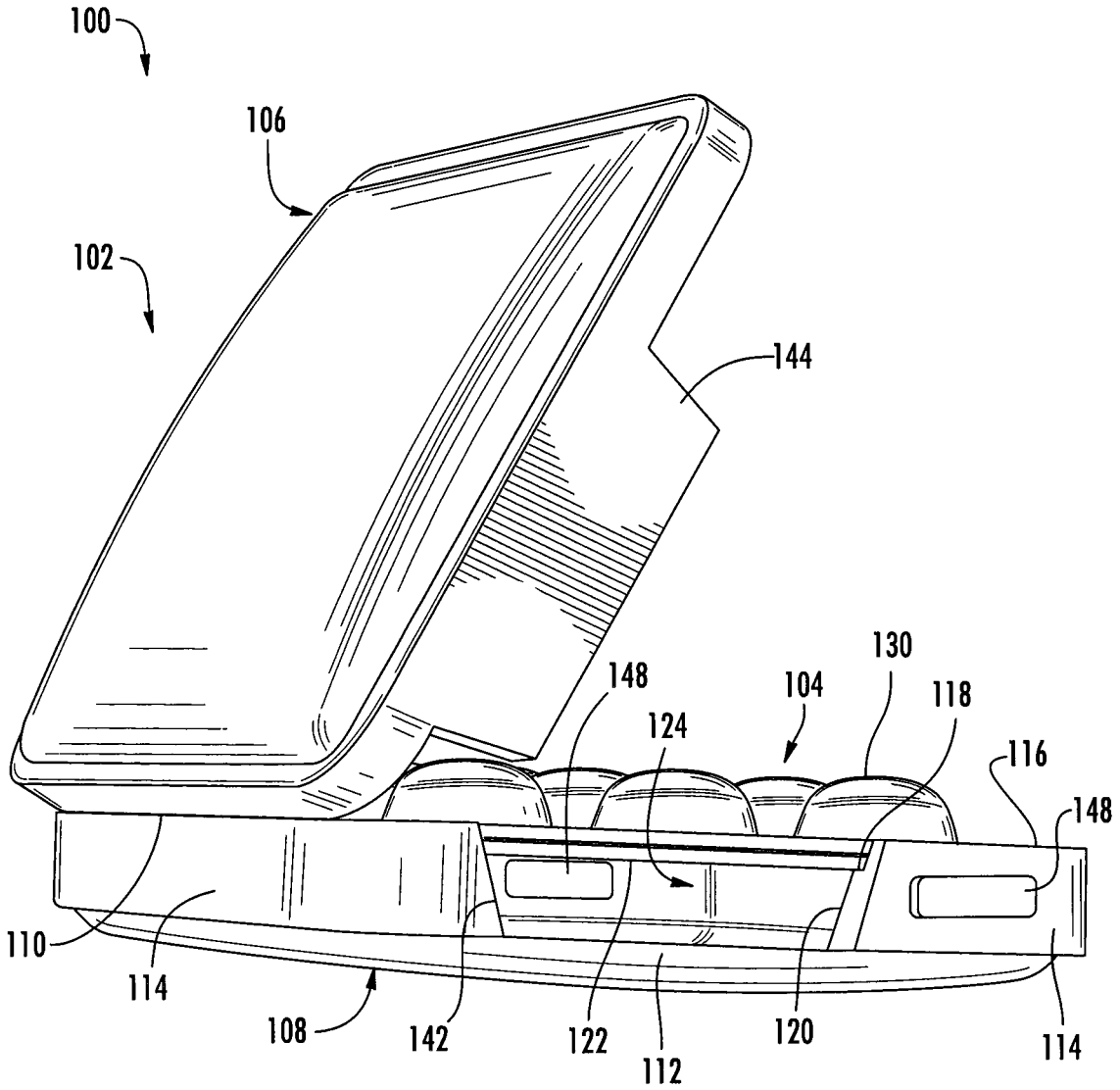
FIG. 3 illustrates an additional alternate perspective view of the packaged product assembly of FIG. 1.

Accordingly, as illustrated in FIG. 3, a receptacle 124 may be defined between the packet 104 and the major wall 112 of the lower casing 108. The packet 104 may be replaceable in some embodiments. For example, the edge 122 of the packet 104 may engage the inner surface 120 of the sidewalls 114 of the lower casing 108 and be retained therein by interference fit and removable by lifting the packet from the lower casing.

Figure 4:
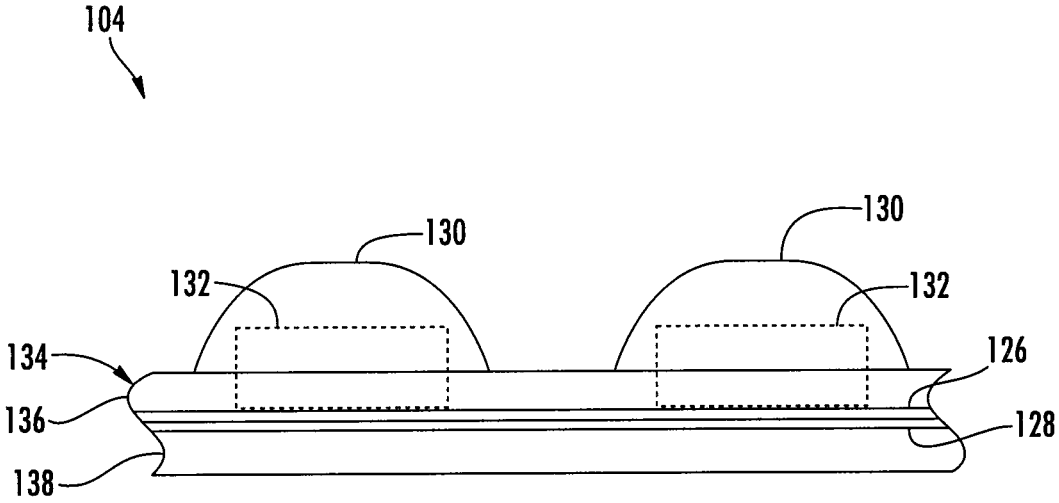
FIG. 4 illustrates an enlarged partial side view of the packet included in the packaged product assembly of FIG. 1.

An enlarged partial side view of the packet 104 is illustrated in FIG. 4. As illustrated, the packet 104 may comprise a displaceable layer 126 and a rupturable layer 128. The displaceable layer 126 may comprise a plastic material in one embodiment, which may be translucent or transparent to allow a user to see therethrough. The rupturable layer 128 may comprise, for example, a foil material or a plastic material.

The displaceable layer 126 and the rupturable layer 128 may collectively define a plurality of sealed cavities 130. In particular, the displaceable layer 126 may form a plurality of bubble shapes, and the rupturable layer 128 may define a substantially planar configuration and seal shut each of the sealed cavities 130 in one embodiment. A plurality of units of a product 132 may be received in the sealed cavities 130. For example, as illustrated, one unit of product 132 may be received in each sealed cavity 130.

The product 132 may comprise a variety of substances in a variety of forms. For example, in one embodiment the product 132 may be a smokeless tobacco product. In other embodiment the product 132 may be selected from the group consisting of pharmaceutical products, smoking products, smokeless tobacco products, and consumable products. In some embodiments the product 132 may be characterized by a shape selected from the group consisting of pill, tablet, orb, sphere, coin, cube, bead, ovoid, obloid, bean, stick, and rod, although the product may be characterized by various other embodiments of shapes. Additional embodiments of products that may be included in the sealed cavities are described in U.S. Patent Application Publication Nos. 2009/0025739 to Brinkley et al.; 2011/0247640 to Beeson et al.; 2012/0055494 to Hunt et al.; 2012/0118310 to Cantrell et al.; 2012/0138073 to Cantrell et al.; and 2012/0138074 to Cantrell et al., each of which is incorporated herein by reference.

As illustrated, the packet 104 may further comprise a frame 134. In one embodiment the frame 134 may comprise an upper layer 136 coupled to the displaceable layer 126 and a lower layer 138 coupled to the rupturable layer 128. The frame 134 may comprise plastic or various other embodiments of relatively rigid materials including, but not limited to metal, various paperboard stocks, and combinations thereof.

The frame 134 may be configured to stiffen the packet 104. In this regard, as illustrated in FIG. 1, the frame 134 may extend around the perimeter of the packet 104. Thus, the frame 134 may engage the shoulder 118 defined by the sidewalls 114 of the lower casing 108. Further, the frame 134 may include a plurality of ribs 140 that extend across the packet 104 in one or more directions. Accordingly, the frame 134 may stiffen the packet 104 such that removal of the units of the product 132 from the sealed cavities is improved.

In this regard, the units of the product 132 may be removed from the sealed cavities 130 by depressing the displaceable layer 126 at one of the sealed cavities. Thereby, the unit of the product 132 may rupture the rupturable layer 128 of the packet 104. The edge 122 of the packet 104 may be supported by the shoulder 118 during this operation and the frame 134 may stiffen the packet such that it resists deflection as the sealed cavity 130 is depressed. Accordingly, the unit of the product 132 may be more easily removed from the packet 104.

The unit of the product 132 may then be received in the receptacle 124 as it falls from the packet 104. In the event that a part of the rupturable layer 128 falls from the packet 104 (e.g., a "chad"), this material may also be received in the receptacle 124. Accordingly, the receptacle 124 may additionally function to capture pieces of the packet 104 which may fall therefrom, such that a user of the packaged product assembly 100 may avoid accidentally dropping pieces of the packet onto the ground.

Then the unit of the product 132 may be removed from the packaged product assembly 100 through a dispensing aperture 142. In the embodiment illustrated in FIGS. 1-3, the dispensing aperture 142 is defined in one of the sidewalls 114 of the lower casing 108. As illustrated, the dispensing aperture 142 may also be defined at least in part by the packet 104, and particularly by a portion of the frame 134 defining an outer perimeter of the packet 104. In this regard, the packet 104 may define an upper end of the dispensing aperture 142.

In order to remove the unit of the product 132, a user may tilt the packaged product assembly 100 with the upper casing 106 in the open position such that the dispensing aperture 142 is oriented downwardly, and the unit of the product may fall therethrough. Accordingly, the contents of a single one of the sealed cavities 130 may be retrieved in a simplified manner and accidental puncture of the sealed cavities or accidental dispensing of the units of the product 132 therein may be averted, because the packet 104 may be protected from damage when the upper casing 106 is in the closed position.

Further, the upper casing 106 may comprise an extension 144 configured to close the dispensing aperture 142 when the upper casing is in the closed position and open the dispensing aperture when the upper casing is in the open position. Thereby, the dispensing container 102 may be substantially sealed shut when the upper casing 106 is in the closed position and the user may be provided with access to the packet 104 and a unit of the product 132 dispensed through the dispensing aperture 142 when the upper casing is in the open position. As illustrated in FIG. 1, the extension 144 may define a recessed portion 146 configured to reduce the amount of material employed to form the upper casing 106 while retaining a profile consistent with the shape of the dispensing aperture 142.

As illustrated in FIG. 1, the packaged product assembly 100 may further comprise one or more buttons 148. In one embodiment the lower casing 108 may comprise buttons 148 positioned on opposing sidewalls 114 of the lower casing 108. The buttons 148 may be configured to release the upper casing 106 from the lower casing 108 in embodiments of the dispensing container 102 comprising a lock mechanism. In this regard, in one embodiment both of the buttons 148 must be depressed at the same time to open the dispensing container 102. For example, a latch may extend between the two buttons 148 that requires depression of each of the buttons in order to release the upper casing 106. Accordingly, the dispensing container 102 may be child-resistant.

Additional embodiments of packaged product assemblies are provided. The additional embodiments of packaged product assemblies may be substantially similar to the embodiment of the packaged product assembly 100 described above and illustrated in FIGS. 1-3. Accordingly, each element of the additional embodiments of packaged product assemblies will not be described in detail below. Rather, elements which differ will be described, and similar elements will be referenced by similar reference numerals. Note that the additional embodiments of the packaged product assemblies may include some or all of the features described above. For example, each of the embodiments of the packaged product assemblies may or may not include the buttons 148.

In this regard, each of the embodiments of the packaged product assemblies disclosed herein may or may not include child-resistant features. Use of child-resistant features at the dispensing container may allow for use of simpler packets therein, which may be easier to operate while still providing child-resistance in terms of opening the dispensing container. Alternatively, use of a child-resistant container in addition to a child-resistant packet may provide an extra level of security. Accordingly, each of the packaged product assemblies may optionally include embodiments of child resistant features.

The embodiments of packaged product assemblies disclosed herein may rely on a variety of mechanisms such as interference fit, concurrent displacement of multiple buttons, sequential displacement of multiple objects, etc. to add child-resistance. Accordingly, it should be understood that the child-resistance mechanisms disclosed herein are provided for example purposes only. One example embodiment of a dispensing container including child-resistant features is described in U.S. Patent Application Publication No. 2011/0204074 to Gelardi et al., which is incorporated herein by reference.

Figure 5:
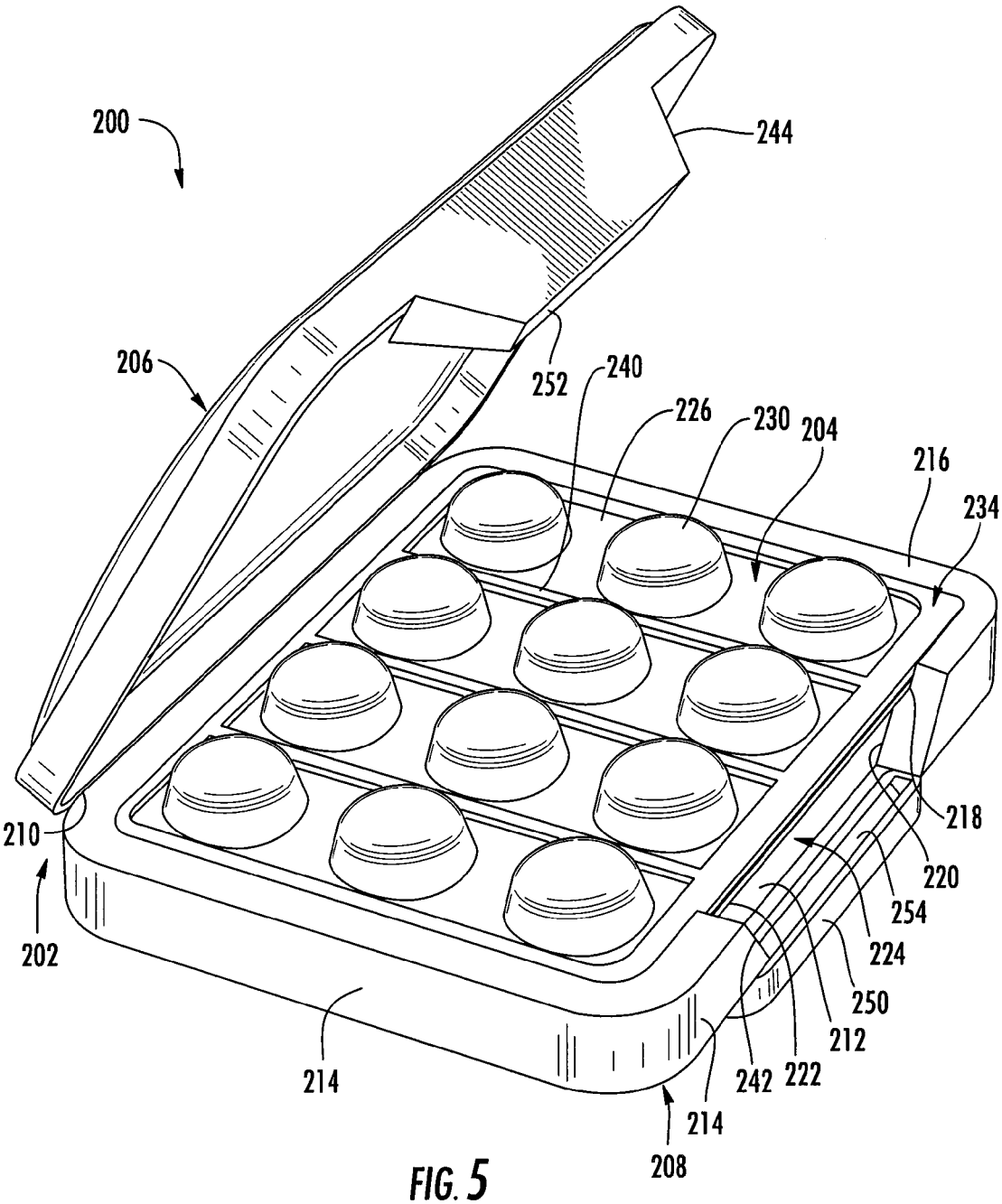
FIG. 5 illustrates a perspective view of a packaged product assembly comprising a packet and a dispensing container with a dispensing aperture closeable via an extension defined by an upper casing of the dispensing container and to which access is limited by a retention member according to a second example embodiment of the present disclosure.
Figure 6:
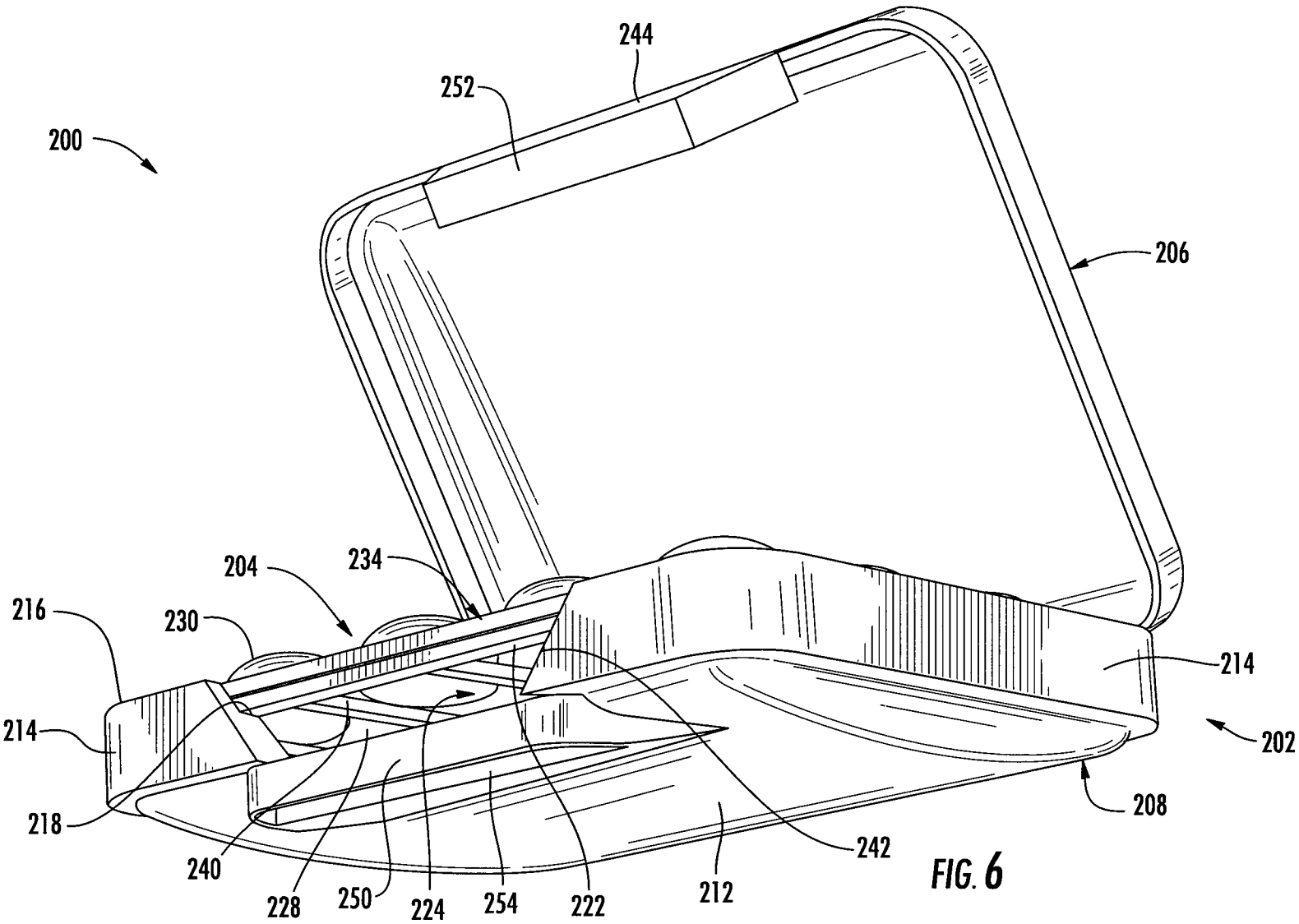
FIG. 6 illustrates an alternate perspective view of the packaged product assembly of FIG. 5.

FIGS. 5 and 6 illustrate a second embodiment of a packaged product assembly 200. The packaged product assembly 200 may include a dispensing container 202 and a packet 204. The dispensing container 202 may comprise an upper casing 206 and a lower casing 208 connected at an edge 210. The lower casing 208 may comprise a major wall 212 and a plurality of sidewalls 214 extending from the major wall to an upper end 216. The sidewalls 214 may define a shoulder 218 extending around an inner surface 220 of the sidewalls. The shoulder 218 may define a flat shelf configured to engage an edge 222 of the packet 204 such that the packet is supported at position between the upper end 216 and the major wall 212 of the lower casing 208. A receptacle 224 may be defined between the packet and the major wall of the lower casing, which may have a dispensing aperture 242 in communication therewith. Further, the upper casing 206 may comprise an extension 244 configured to close the dispensing aperture 242 when the upper casing is in the closed position and open the dispensing aperture when the upper casing is in the open position.

The packet 204 may comprise a displaceable layer 226 and a rupturable layer 228. The displaceable layer 226 and the rupturable layer 228 may collectively define a plurality of sealed cavities 230. A plurality of units of a product may be received in the sealed cavities 230. The packet 204 may further comprise a frame 234, which may include a plurality of ribs 240 that extend across the packet 204 in one or more directions.

The packaged product assembly 200 differs from the embodiment of the packaged product assembly illustrated in FIGS. 1-3 in that the dispensing aperture 242 is positioned at a sidewall 214 opposite the edge 210 at which the upper casing 206 and the lower casing 208 are connected, as opposed to at a sidewall perpendicular thereto. Accordingly, the extension 244 of the upper casing 206 is also positioned opposite the edge 210 at which the upper casing and the lower casing 208 are connected.

The packaged product assembly 200 additionally differs in that the lower casing 208 further comprises a retention member 250 configured to at least partially limit access to the extension 244 of the upper casing 206 when the upper casing 206 is in a closed position. In this regard, the retention member 250 may extend beneath an end 252 of the extension 244 when the upper casing 206 is configured in the closed position. For example, the retention member 250 and the extension 244 may define a planar configuration at the outer surfaces thereof in the closed position. Accordingly, the retention member 250 may function to limit accidental opening of the dispensing container 202 and resist opening of the dispensing container by a child.

However, in order to facilitate intentional opening of the dispensing container 102 by an adult, the retention member 250 may be configured to flex into the area defined by an aperture 254 positioned between the retention member 250 and the remainder of the lower casing 208. Accordingly, a user may flex the retention member 250 inwardly toward the aperture 254, such that access to the end 252 of the extension 244 is provided. The user may then lift the end 252 of the extension 244 and pivot the upper casing 206 to the open position. Additionally, the upper casing 206 may engage the lower casing 208 via interference fit or a latch such that lifting the upper casing requires applying a sufficient lifting force.

Figure 7:
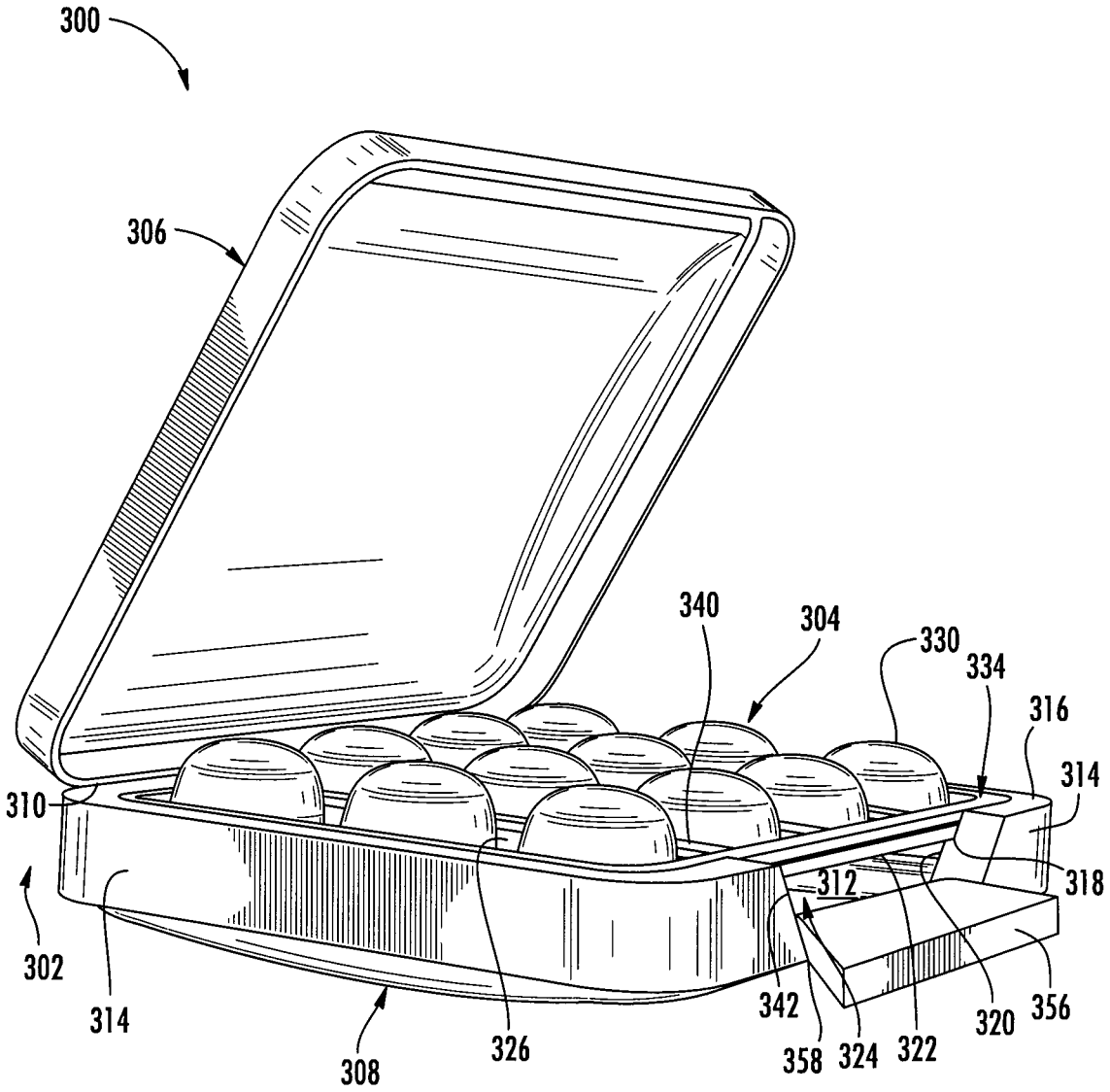
FIG. 7 illustrates a perspective view of a packaged product assembly comprising a packet and a dispensing container with a dispensing aperture in a sidewall closeable via a door according to a third example embodiment of the present disclosure.

FIG. 7 illustrates a third embodiment of a packaged product assembly 300. The packaged product assembly 300 may include a dispensing container 302 and a packet 304. The dispensing container 302 may comprise an upper casing 306 and a lower casing 308 connected at an edge 310. The lower casing 308 may comprise a major wall 312 and a plurality of sidewalls 314 extending from the major wall to an upper end 316. The sidewalls 314 may define a shoulder 318 extending around an inner surface 320 of the sidewalls. The shoulder 318 may define a flat shelf configured to engage an edge 322 of the packet 304 such that the packet is supported at position between the upper end 316 and the major wall 312 of the lower casing 308. A receptacle 324 may be defined between the packet and the major wall of the lower casing, which may have a dispensing aperture 342 in communication therewith.

The packet 304 may comprise a displaceable layer 326 and a rupturable layer. The displaceable layer 326 and the rupturable layer may collectively define a plurality of sealed cavities 330. A plurality of units of a product may be received in the sealed cavities 330. The packet 204 may further comprise a frame 334, which may include a plurality of ribs 340 that extend across the packet 304 in one or more directions.

The dispensing aperture 342 may be positioned at a sidewall 314 opposite the edge 310 at which the upper casing 306 and the lower casing 308 are connected as described above with respect to the packaged product assembly 200 illustrated in FIGS. 5 and 6. However, instead of employing an extension coupled to the upper casing 306 to open and close the dispensing aperture 342, the lower casing 308 comprises a door 356 configured to pivot to open and close the dispensing aperture.

For example, the door 356 may be integral with the remainder of the lower casing and connected thereto by a thin strip of material at an edge 358. However, in other embodiments a separate hinge may be provided to connect the door 356 to the remainder of the lower casing 308. The door 356 may connect to and pivot about the major wall 312 to close the dispensing aperture 342 in some embodiments. Although illustrated as being opposite the edge 310 at which the upper casing 306 and the lower casing 308 are connected, the dispensing aperture 342 and the door 356 may alternatively be positioned at one of the sidewalls 314 perpendicular thereto.

Figure 8:
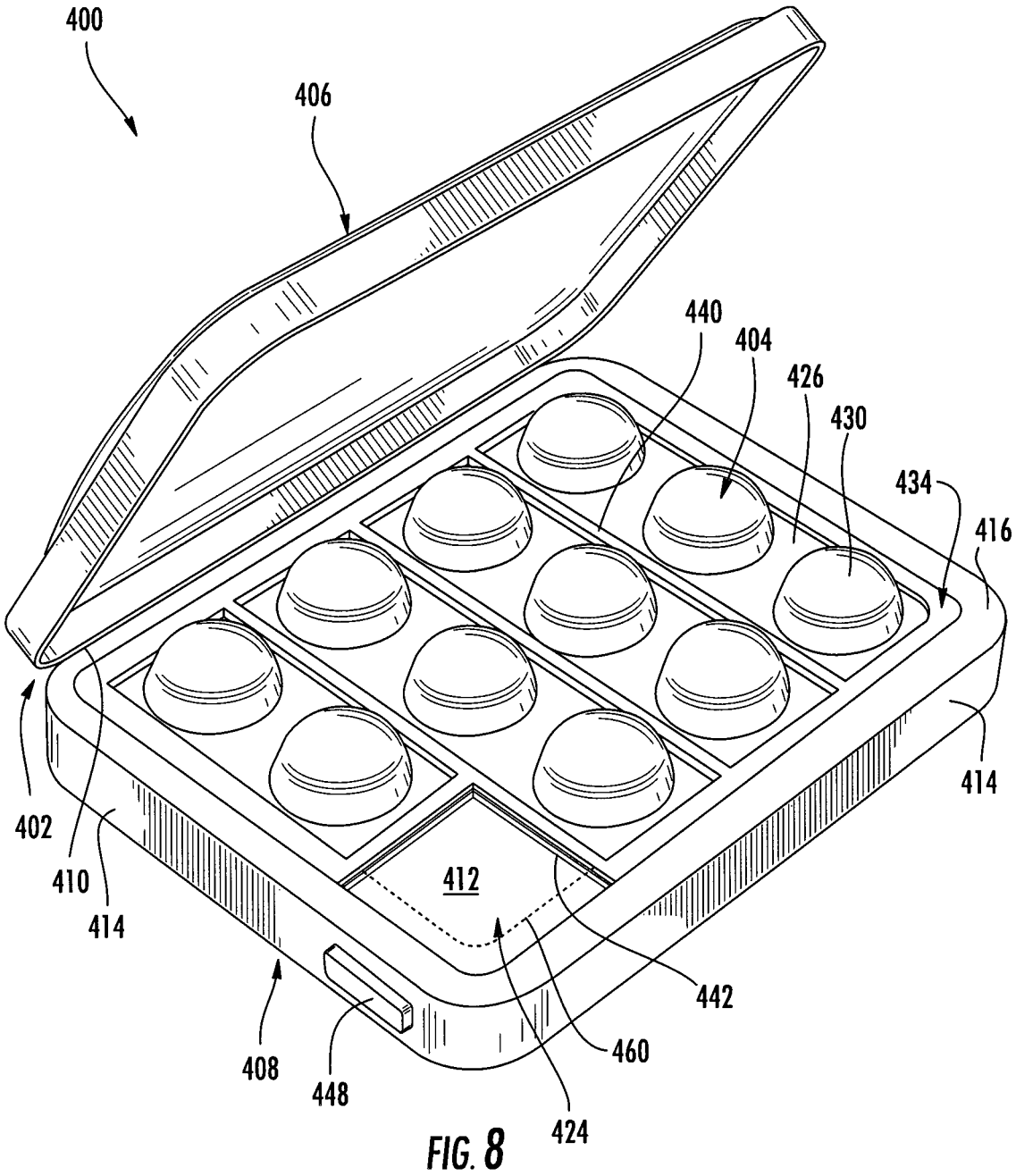
FIG. 8 illustrates a perspective view of a packaged product assembly comprising a dispensing aperture formed from a cutout in a packet according to a fourth example embodiment of the present disclosure.

FIG. 8 illustrates a fourth embodiment of a packaged product assembly 400. The packaged product assembly 400 may include a dispensing container 402 and a packet 404. The dispensing container 402 may comprise an upper casing 406 and a lower casing 408 connected at an edge 410. The lower casing 408 may comprise a major wall 412 and a plurality of sidewalls 414 extending from the major wall to an upper end 416. The sidewalls 414 may define a shoulder extending around an inner surface of the sidewalls. The shoulder 418 may define a flat shelf configured to engage an edge of the packet 404 such that the packet is supported at position between the upper end 416 and the major wall 412 of the lower casing 408. A receptacle 424 may be defined between the packet and the major wall of the lower casing, which may have a dispensing aperture 442 in communication therewith. The packaged product assembly 400 may further comprise one or more buttons 448, which may be configured to release the upper casing 406 from the lower casing 408 in embodiments of the dispensing container 402 comprising a lock mechanism.

The packet 404 may comprise a displaceable layer 426 and a rupturable layer. The displaceable layer 426 and the rupturable layer may collectively define a plurality of sealed cavities 430. A plurality of units of a product may be received in the sealed cavities 430. The packet 404 may further comprise a frame 434, which may include a plurality of ribs 440 that extend across the packet 404 in one or more directions.

The packaged product assembly 400 differs from the previously described embodiments of packaged product assemblies in that the dispensing aperture is not defined as a hole or recess in the lower casing 408. Rather, as illustrated, the dispensing aperture 442 is defined as a cutout in the packet 404. Embodiments in which the dispensing aperture 442 is defined by a cutout in the packet 404 may be preferable in some instances in that these embodiments avoid the need for a separate door or extension to close the dispensing aperture.

As illustrated by solid lines, in one embodiment the packet 404 may terminate at the dispensing aperture 442, such that the dispensing aperture is defined in part by the packet and defined in part by the sidewalls 414 of the lower casing 408. However, in another embodiment, as illustrated by a dashed line 460, the frame 434 may extend around the dispensing aperture 442 such that the dispensing aperture is defined entirely by the packet 404. Embodiments in which the frame 434 extends around the dispensing aperture 442 may assist in retaining a unit of product received in the receptacle 424 by defining a lip surrounding the dispensing aperture, which may be preferable where accidental dispensing is a concern. Conversely, embodiments in which the frame 334 does not extend entirely around the dispensing aperture 442 may be preferable where ease of retrieving the unit of product from the receptacle 424 is desired, since the unit of product will not have to travel over a lip to be dispensed.

Figure 9:
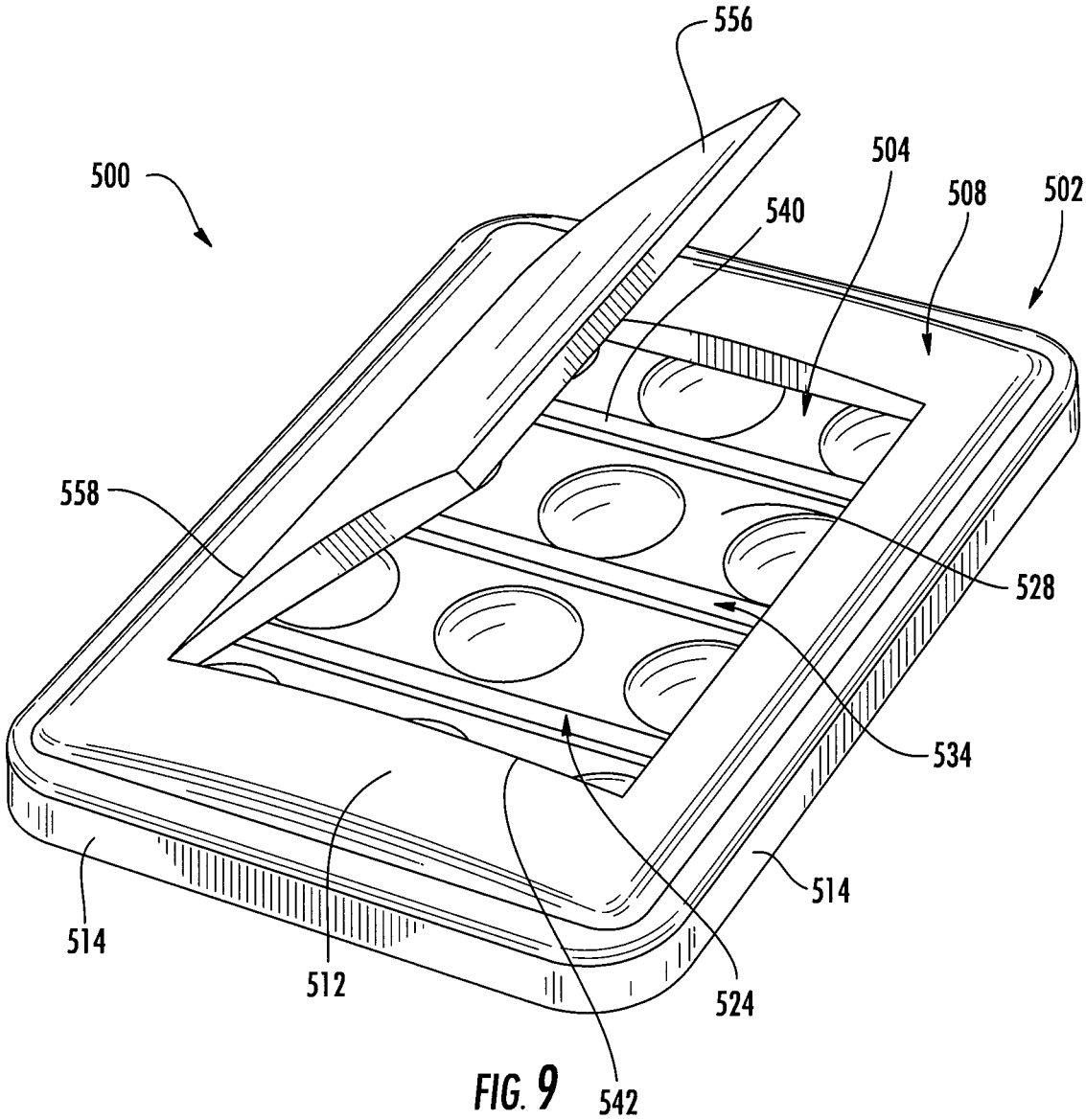
FIG. 9 illustrates a perspective view of a packaged product assembly comprising a packet and a dispensing container with a dispensing aperture in a major wall closeable via a door according to a fifth example embodiment of the present disclosure.
Figure 10:
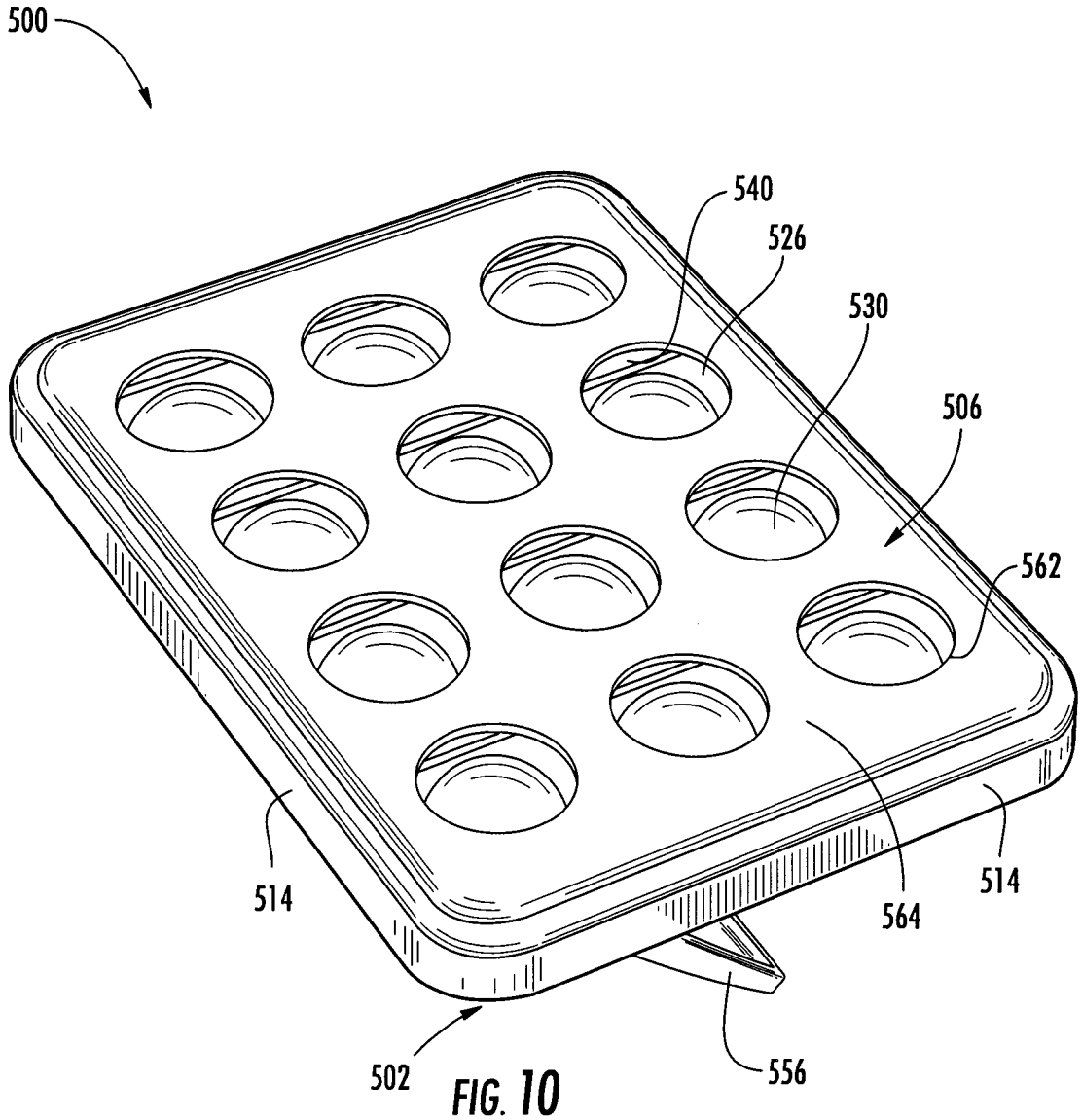
FIG. 10 illustrates an alternate perspective view of the packaged product assembly of FIG. 9.

FIGS. 9 and 10 illustrate a fifth embodiment of a packaged product assembly 500. The packaged product assembly 500 may include a dispensing container 502 and a packet 504. The dispensing container 502 may comprise an upper casing 506 and a lower casing 508. The lower casing 508 may comprise a major wall 512 and a plurality of sidewalls 514 extending from the major wall. The sidewalls 514 may define a shoulder extending around an inner surface of the sidewalls. The shoulder may define a flat shelf configured to engage an edge of the packet 504 such that the packet is supported at position between an upper end of the sidewalls and the major wall 512 of the lower casing 508. A receptacle 524 may be defined between the packet 504 and the major wall 512 of the lower casing 508, which may have a dispensing aperture 542 in communication therewith.

The packet 504 may comprise a displaceable layer 526 and a rupturable layer 528. The displaceable layer 526 and the rupturable layer 528 may collectively define a plurality of sealed cavities 530. A plurality of units of a product may be received in the sealed cavities 530. The packet 504 may further comprise a frame 534, which may include a plurality of ribs 540 that extend across the packet 504 in one or more directions.

As illustrated in FIG. 9, the packaged product assembly 500 differs from the previously described embodiments of packaged product assemblies in that the lower casing comprises a door 556 connected thereto by a thin strip of material at an edge 558. More particularly, the dispensing aperture 542 is defined in the major wall 512 of the lower casing 508, and the door 556 is configured to pivot about the major wall 512 to open and close the dispensing aperture 542. Accordingly, a unit of the product may be retrieved through the dispensing aperture 542 in the major wall 512 of the lower casing 508 in this embodiment after being released from one of the sealed cavities 530. In some embodiments a child-resistant feature may be provided at the door 556.

As illustrated in FIG. 10, the packaged product assembly 500 further differs in that the upper casing 506 defines a plurality of access ports 562 aligned with the sealed cavities 530 in the packet 504 and configured to provide access to the sealed cavities. More particularly, the access ports 562 may be defined in a major wall 564 of the upper casing 506. Accordingly, a user may extend a finger through one of the access ports 562 to depress the depressible layer 526 of the packet 504 at one of the sealed cavities 530 to release a unit of product from the sealed cavity and direct the unit of product into the receptacle 524. Accordingly, the packaged product assembly 500 may be preferable in that it does not require opening of the upper casing 506 to rupture one of the sealed cavities 530 in the packet. Further, the upper casing 506 and the lower casing 508 may not be pivotably connected to one another, since opening the dispensing container 502 is not required to remove units of the product from the sealed cavities 530. Thus, for example, the upper casing 506 and the lower casing 508 may couple via interference fit. Alternatively, the upper casing 506 and the lower casing 508 may be glued or otherwise permanently coupled in embodiments in which the packet 504 is not replaceable.

Note that the embodiments of packaged product assemblies included herein are generally described as having an upper casing and a lower casing, in which the lower casing supports a packet on a shoulder. However, in other embodiments a second packet may be included in the upper casing. By way of example, with the exception of certain child-resistant features such as latches, etc., the upper casing and the lower casing may be substantially mirror-images of one-another.

Thus, for example, the upper casing may comprise a major wall and a plurality of sidewalls extending from the major wall to an end, the sidewalls defining a shoulder extending around an inner surface thereof and configured to engage an edge of a second packet defining a plurality of sealed cavities in which a plurality of units of a product are received such that the packet is supported at a position between the end and the major wall. Further, a receptacle may be defined between the packet and the major wall of the lower casing. The receptacle may be configured to receive one of the units of the product from one of the sealed cavities of the second packet and the one of the units of the product may be removable from the receptacle via a dispensing aperture in the lower casing.

Use of this configuration may allow for a relatively smaller packaged product assembly in terms of the width and length thereof. However, the thickness of the packaged product assembly may be somewhat greater due to packets being included in both the upper casing and the lower casing.

Figure 11:
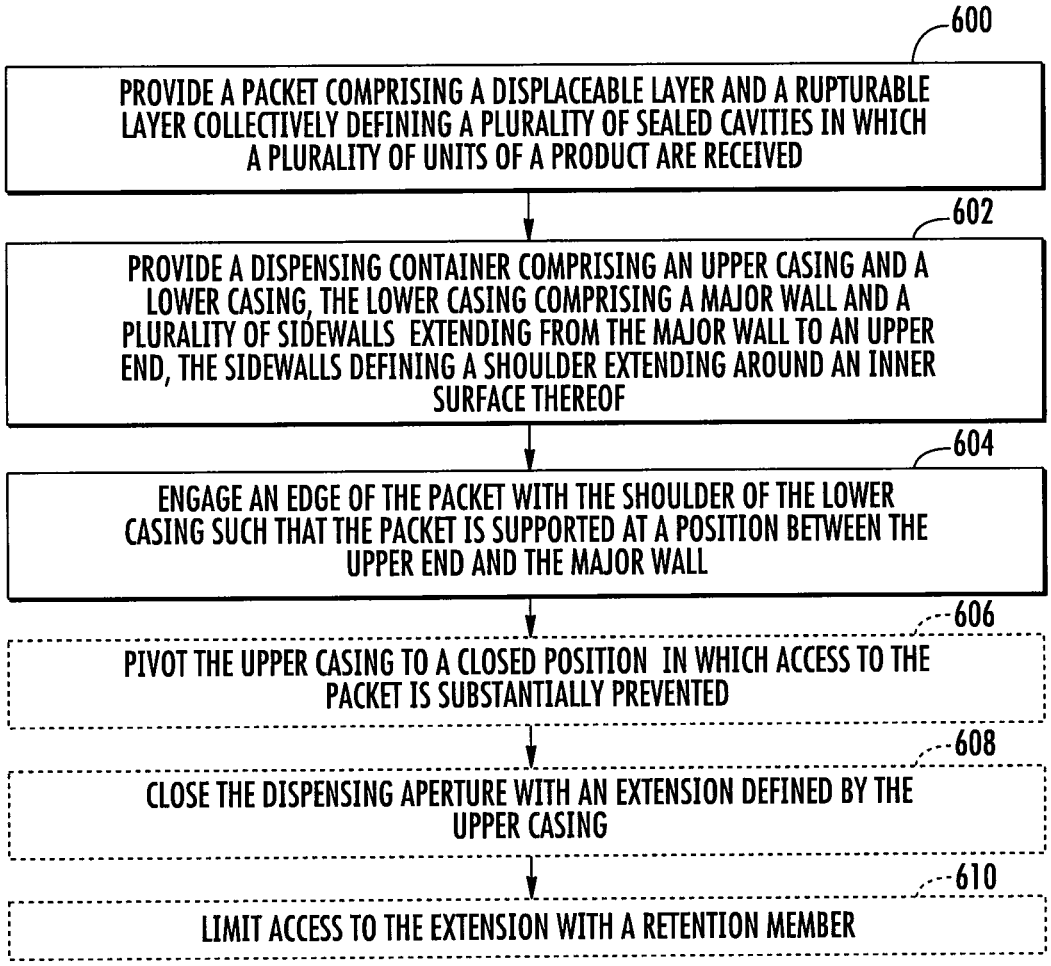
FIG. 11 schematically illustrates a method for producing a packaged product assembly to an example embodiment of the present disclosure.

Embodiments of related methods are also provided. In this regard, FIG. 11 illustrates an example embodiment of a method for producing a packaged product assembly. The method may include providing a packet at operation 600. The packet may comprise a displaceable layer and a rupturable layer collectively defining a plurality of sealed cavities in which a plurality of units of a product are received. The method may further comprise providing a dispensing container at operation 602. The dispensing container may comprise an upper casing and a lower casing, the lower casing comprising a major wall and a plurality of sidewalls extending from the major wall to an upper end, the sidewalls defining a shoulder extending around an inner surface thereof. Additionally, the method may include engaging an edge of the packet with the shoulder of the lower casing such that the packet is supported at a position between the upper end and the major wall at operation 604. The packaged product assembly may thereby be configured such that upon depressing the displaceable layer of the packet at one of the sealed cavities one of the units of the product ruptures the rupturable layer of the packet and is received in a receptacle defined between the packet and the major wall of the lower casing and the one of the units of the product is removable from the receptacle via a dispensing aperture.

In some embodiments the method may additionally include other optional operations, which are indicated by boxes including dashed lines. In this regard, additional operations may include pivoting the upper casing to a closed position in which access to the packet is substantially prevented at operation 606. Pivoting the upper casing to a closed configuration at operation 606 may comprise closing the dispensing aperture with an extension defined by the upper casing at operation 608. Further, the method may include limiting access to the extension with a retention member at operation 610.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispensing container, comprising:

an upper casing; and a lower casing configured to engage the upper casing, the lower casing comprising a major wall and a plurality of sidewalls extending from the major wall to an upper end, the sidewalls defining a shoulder extending around an inner surface thereof and configured to engage an edge of a packet defining a plurality of sealed cavities in which a plurality of units of a product are received such that the packet is supported at a position between the upper end and the major wall, wherein a receptacle defined between the packet and the major wall of the lower casing is configured to receive one of the units of the product from one of the sealed cavities and the one of the units of the product is removable from the receptacle via a dispensing aperture defined in one of the sidewalls of the lower casing, wherein the upper casing is pivotably coupled to the lower casing and the upper casing comprises an extension configured to close the dispensing aperture when the upper casing is in a closed position and open the dispensing aperture when the upper casing is in an open position.

2. The dispensing container of claim 1, wherein the upper casing prevents access to the packet when configured in a closed position.

3. The dispensing container of claim 1, further comprising a button configured to release the upper casing from the lower casing to provide access to the packet.

4. A packaged product assembly, comprising:

a packet comprising a displaceable layer and a rupturable layer collectively defining a plurality of sealed cavities in which a plurality of units of a product are received; and a dispensing container, comprising:

an upper casing; and a lower casing configured to engage the upper casing, the lower casing comprising a major wall and a plurality of sidewalls extending from the major wall to an upper end, the sidewalls defining a shoulder extending around an inner surface thereof and engaged with an edge of the packet such that the packet is supported at a position between the upper end and the major wall, wherein upon depressing the displaceable layer of the packet at one of the sealed cavities one of the units of the product ruptures the rupturable layer of the packet and is received in a receptacle defined between the packet and the major wall of the lower casing and the one of the units of the product is removable from the receptacle via a dispensing aperture defined in one of the sidewalls of the lower casing, wherein the upper casing is pivotably coupled to the lower casing and the upper casing comprises an extension configured to close the dispensing aperture when the upper casing is in a closed position and open the dispensing aperture when the upper casing is in an open position.

5. The packaged product assembly of claim 4, wherein the upper casing prevents access to the packet when configured in a closed position.

6. The packaged product assembly of claim 4, wherein the packet comprises a frame configured to stiffen the packet.

7. The packaged product assembly of claim 4, further comprising a button configured to release the upper casing from the lower casing to provide access to the packet.

8. The packaged product assembly of claim 4, wherein the dispensing aperture is defined at least in part by the packet.

9. The packaged product assembly of claim 4, wherein the packet is replaceable.

10. The packaged product assembly of claim 4, wherein the product is selected from the group consisting of pharmaceutical products, smoking products, smokeless tobacco products, and consumable products.

11. The packaged product assembly of claim 4, wherein the product is a smokeless tobacco product.

12. A method, comprising:

providing a packet comprising a displaceable layer and a rupturable layer collectively defining a plurality of sealed cavities in which a plurality of units of a product are received;

providing a dispensing container comprising an upper casing and a lower casing, the lower casing comprising a major wall and a plurality of sidewalls extending from the major wall to an upper end, the sidewalls defining a shoulder extending around an inner surface thereof;

engaging an edge of the packet with the shoulder of the lower casing such that the packet is supported at a position between the upper end and the major wall, wherein upon depressing the displaceable layer of the packet at one of the sealed cavities one of the units of the product ruptures the rupturable layer of the packet and is received in a receptacle defined between the packet and the major wall of the lower casing and the one of the units of the product is removable from the receptacle via a dispensing aperture; and closing the dispensing aperture with an extension defined by the upper casing to substantially prevent access to the packet by pivoting the upper casing to a closed configuration.

* * * * *